US009790649B2

(12) United States Patent
Sandler

(10) Patent No.: US 9,790,649 B2
(45) Date of Patent: Oct. 17, 2017

(54) TRUCK-MOUNTED MATERIAL SPREADER

(71) Applicant: Buyers Products Company, Mentor, OH (US)

(72) Inventor: Philip Sandler, Mayfield Village, OH (US)

(73) Assignee: Buyers Products Company, Mentor, OH (US)

( * ) Notice: Subject to any disclaimer, the term of this patent is extended or adjusted under 35 U.S.C. 154(b) by 97 days.

(21) Appl. No.: 14/533,719

(22) Filed: Nov. 5, 2014

(65) Prior Publication Data

US 2015/0053796 A1 Feb. 26, 2015

Related U.S. Application Data

(62) Division of application No. 13/043,951, filed on Mar. 9, 2011, now Pat. No. 8,888,025.

(60) Provisional application No. 61/312,206, filed on Mar. 9, 2010.

(51) Int. Cl.
*E01C 19/00* (2006.01)
*E01C 19/20* (2006.01)

(52) U.S. Cl.
CPC ..... *E01C 19/203* (2013.01); *E01C 2019/208* (2013.01)

(58) Field of Classification Search
CPC .. E01C 19/20; E01C 19/203; E01C 2019/208; E05D 15/502; E05D 15/505; B05R 7/04
USPC ..... 239/650–689; 414/462; 224/488, 495, 224/510, 513, 519, 521
See application file for complete search history.

(56) References Cited

U.S. PATENT DOCUMENTS 2,677,479 A * 5/1954 Kiba ..... E05D 5/10 16/257
3,333,726 A * 8/1967 Belanger ..... E05D 7/1072 16/257
3,365,094 A * 1/1968 Palson ..... A45C 13/005 16/257
3,819,120 A * 6/1974 Walker ..... E01C 19/203 239/661
4,362,272 A * 12/1982 Martin ..... A01C 3/063 198/664
5,067,625 A * 11/1991 Numata ..... A45C 11/24 220/230

(Continued)

*Primary Examiner* — Arthur O Hall
*Assistant Examiner* — Viet Le
(74) *Attorney, Agent, or Firm* — Renner, Otto, Boiselle & Sklar, LLP

(57) ABSTRACT

A material spreader is mountable to a rearwardly projecting bumper of a vehicle for conveying and spreading material, the vehicle including a rearwardly projecting hitch receiver. The material spreader includes a hopper for holding material to be spread, a frame supporting the hopper and having a forwardly projecting hitch mount configured for coupling to the rearwardly projecting hitch receiver of the vehicle, and a support member having an underside for resting atop a top surface of the bumper, the support member being movable vertically relative to the frame. A tie down is connected to the support member and the frame for urging the support member and the hitch mount towards one another to effect a clamping action on the receiver and the bumper. The material spreader also includes a dual hinged lid and a gear box for driving a spinner and an auger.

12 Claims, 8 Drawing Sheets

(56) References Cited

U.S. PATENT DOCUMENTS

| | | | | | |
|---|---|---|---|---|---|
| 5,106,002 | A | | 4/1992 | Smith et al. | |
| 5,210,906 | A | * | 5/1993 | Aihara | B60R 7/04 16/232 |
| 5,265,809 | A | * | 11/1993 | Kuhn | A01C 3/063 198/311 |
| 5,310,100 | A | | 5/1994 | Liscinsky | |
| 5,675,934 | A | * | 10/1997 | Park | E05D 15/505 16/232 |
| 5,926,916 | A | * | 7/1999 | Lee | E05D 15/502 16/230 |
| 5,967,427 | A | | 10/1999 | Seymour | |
| 7,118,053 | B2 | | 10/2006 | Truan et al. | |
| 7,686,364 | B2 | * | 3/2010 | Hehn | B60R 7/04 220/812 |
| 2003/0213808 | A1 | | 11/2003 | Berger | |
| 2008/0197648 | A1 | * | 8/2008 | Smith | B60R 7/04 296/24.34 |
| 2009/0032624 | A1 | * | 2/2009 | Truan | E01C 19/203 239/675 |

* cited by examiner

TRUCK-MOUNTED MATERIAL SPREADER

This application is a divisional of U.S. Nonprovisional application Ser. No. 13/043,951 filed on Mar. 9, 2011, which claims priority to U.S. application Ser. No. 61/312,206 filed Mar. 9, 2010 which are hereby incorporated herein by reference.

FIELD OF THE INVENTION

The present invention relates generally to a material spreader mountable to a vehicle for conveying and spreading material.

BACKGROUND OF THE INVENTION

Material spreaders are commonly used for carrying and spreading materials, such as salt or sand, on surfaces such as sidewalks, parking lots, driveways, roadways and the like. Material spreaders typically include a hopper for storing the material, a frame for supporting the hopper and attaching it to the rear of a vehicle, and a spreading mechanism for distributing the material.

Material spreaders can be attached to a vehicle in a variety of ways. For example, the material spreader can be attached to a rear portion of a vehicle by coupling the frame to a trailer hitch on the vehicle. Alternatively, the vehicle may be modified by attaching mounting brackets to the rear bumper for example, by drilling holes in the bumper and attaching the mounting brackets by bolts. The material spreader can include corresponding mounting brackets for mating with the mounting brackets on the bumper to connect the material spreader to the vehicle.

SUMMARY OF THE INVENTION

The present invention provides a material spreader that is attached to the vehicle by connecting it to a vehicle hitch such that a hopper rests on top of a rear bumper of the vehicle. A tie down on the material spreader provides a clamping action between the hopper and the vehicle hitch to hold the material spreader on the rear bumper of the vehicle with a clamping force. The material spreader can be easily attached to and removed from a vehicle without the need for extensive and/or permanent vehicle modifications.

More particularly, the material spreader is mountable to a rearwardly projecting bumper of a vehicle for conveying and spreading material. The material spreader includes a hopper for holding material to be spread and a frame that supports the hopper and has a forwardly projecting hitch mount configured for coupling to a rearwardly projecting hitch receiver on the vehicle. A support has an underside for resting atop a top surface of the bumper and the support is movable vertically relative to the frame. A tie down is connected between the support and the frame for urging the support and the hitch mount towards one another to effect a clamping action on the receiver and the bumper. In a preferred embodiment, the support is unitary with the hopper.

The material spreader also provides a unique pivoting connection for a hopper lid that enables/facilitates the loading of the hopper from different sides of the vehicle.

More particularly, the material spreader includes a hopper for holding material to be spread and a lid for closing an open top of the hopper. The hopper has first and second sides and first and second sets of laterally spaced apart hopper hinge elements. The lid has first and second sets of laterally spaced apart lid hinge elements respectively configured for connection to corresponding first and second sets of hopper hinge elements. The hinge elements of a first one of the corresponding sets are releasable to allow the lid to pivot upwardly to a first open position about the hinge elements of a second one of the corresponding sets. The hinge elements of the second one of the corresponding sets are releasable to allow the lid to pivot upwardly to a second open position about the hinge elements of the first one of the corresponding sets. In a preferred embodiment, one set of hinge elements for each corresponding set of hinge elements are laterally deflectable to release the corresponding set of hinge elements.

According to another aspect, the material spreader includes a spinner, an auger for feeding material from the hopper on to the spinner, and a drive assembly for driving the auger and the spinner. The drive assembly includes a motor, a drive shaft connected at opposite ends to a motor and a spinner whereby the spinner operates at the same rotational speed as the motor, and a gear reduction assembly connected between the auger and the drive shaft for driving the auger at a slower rotational speed that the spreader.

Further features of the invention will become apparent from the following detailed description when considered in conjunction with the drawings.

DETAILED DESCRIPTION

Figure 1:
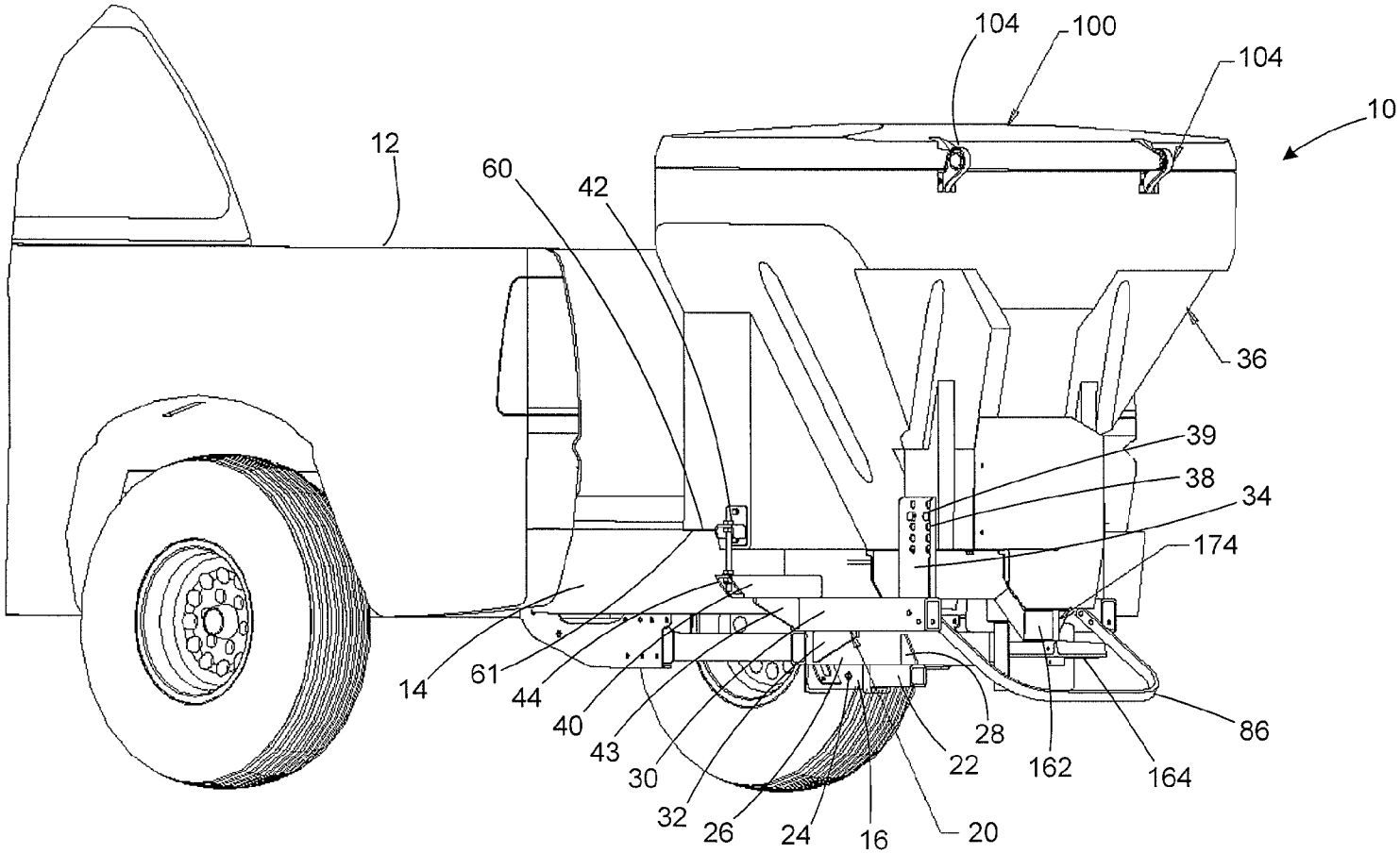
FIG. 1 is an isometric view of an exemplary material spreader mounted on a rear end of a truck.
Figure 2:
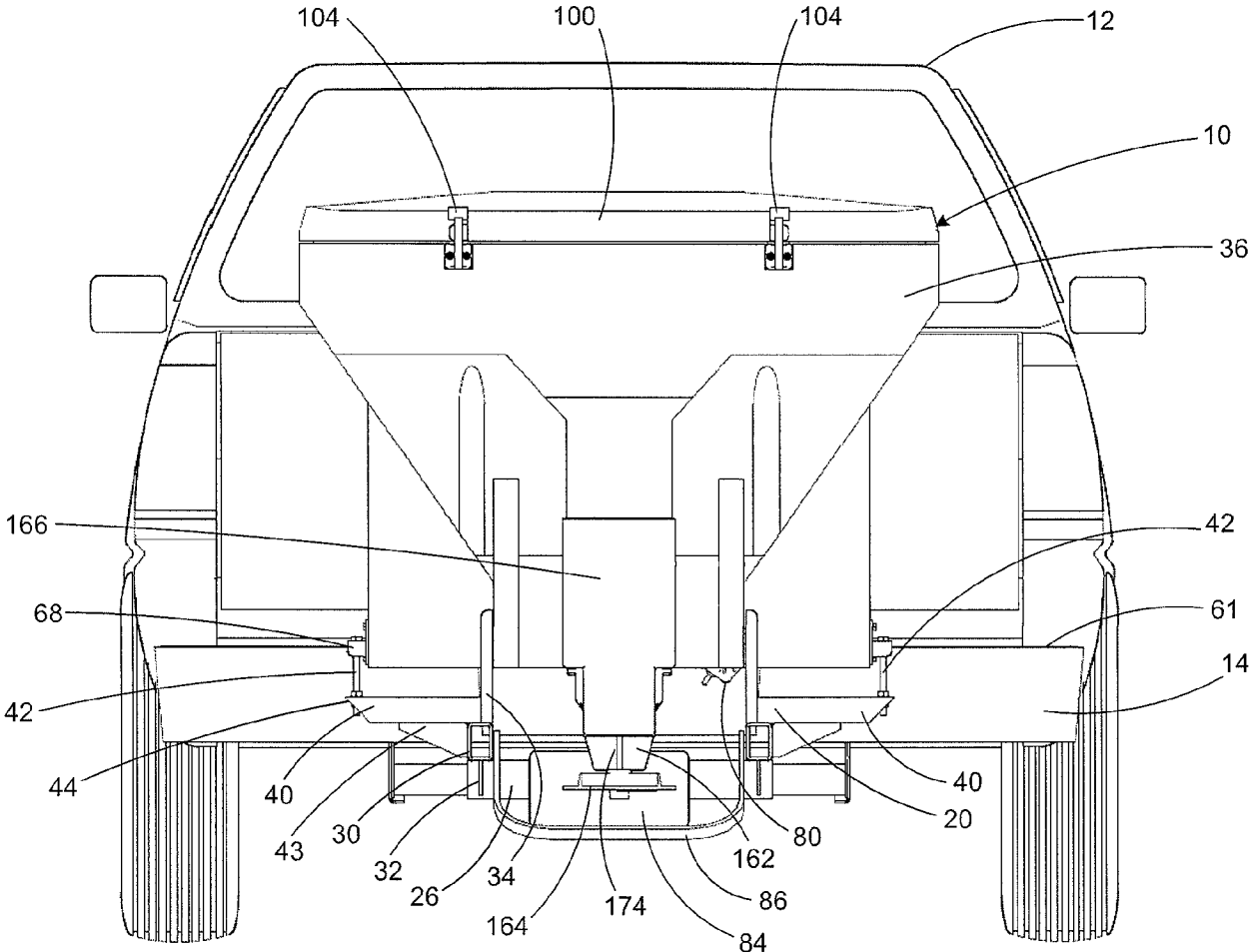
FIG. 2 is a rear elevational view of the exemplary material spreader mounted on the rear end of the truck.
Figure 3:
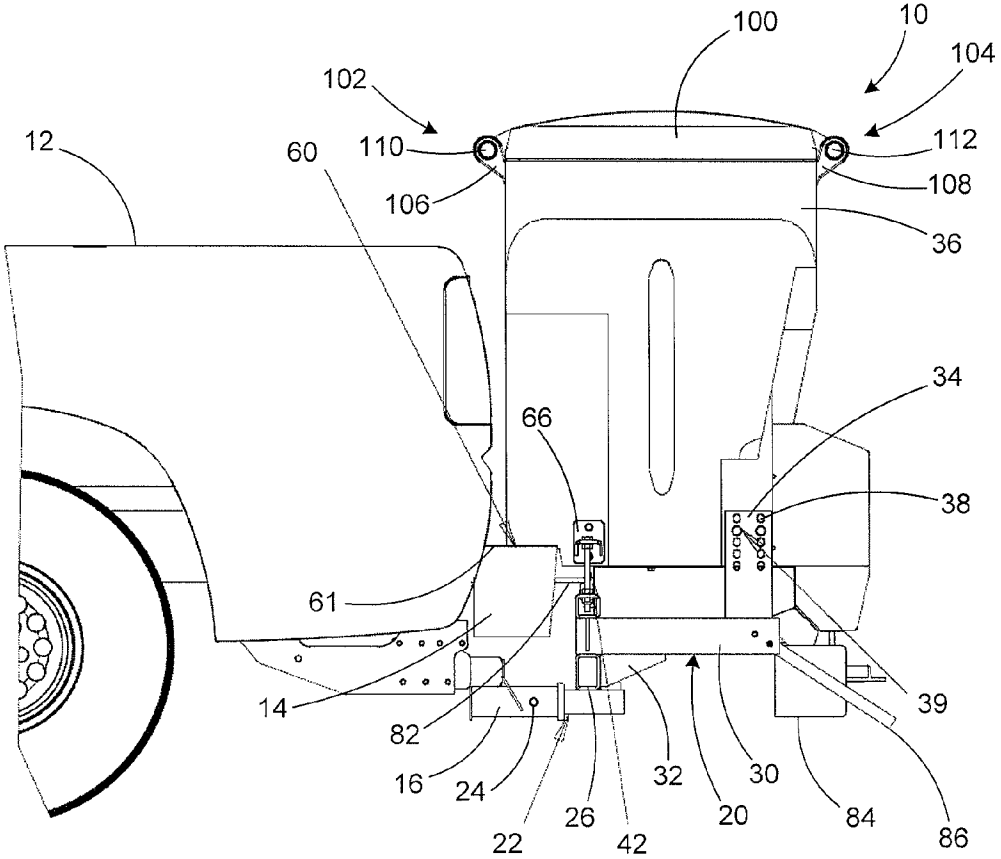
FIG. 3 is a side elevational view of the exemplary material spreader mounted on the rear end of the truck.

Referring to FIGS. 1-3, an exemplary material spreader 10 is shown mounted to a vehicle 12 for conveying and spreading a spreadable material, for example, a pickup truck. The truck includes a rearwardly projecting rear bumper 14, e.g., a bumper that projects rearwardly outwardly beyond the rear gate of the pickup truck so that the top surface of the bumper is upwardly exposed. Below the rear bumper is a rearwardly projecting hitch receiver 16. As is conventional, the hitch receiver can be fixedly attached to the vehicle, for example, by bolting or otherwise affixing the hitch receiver to the frame of the vehicle.

Figure 4:
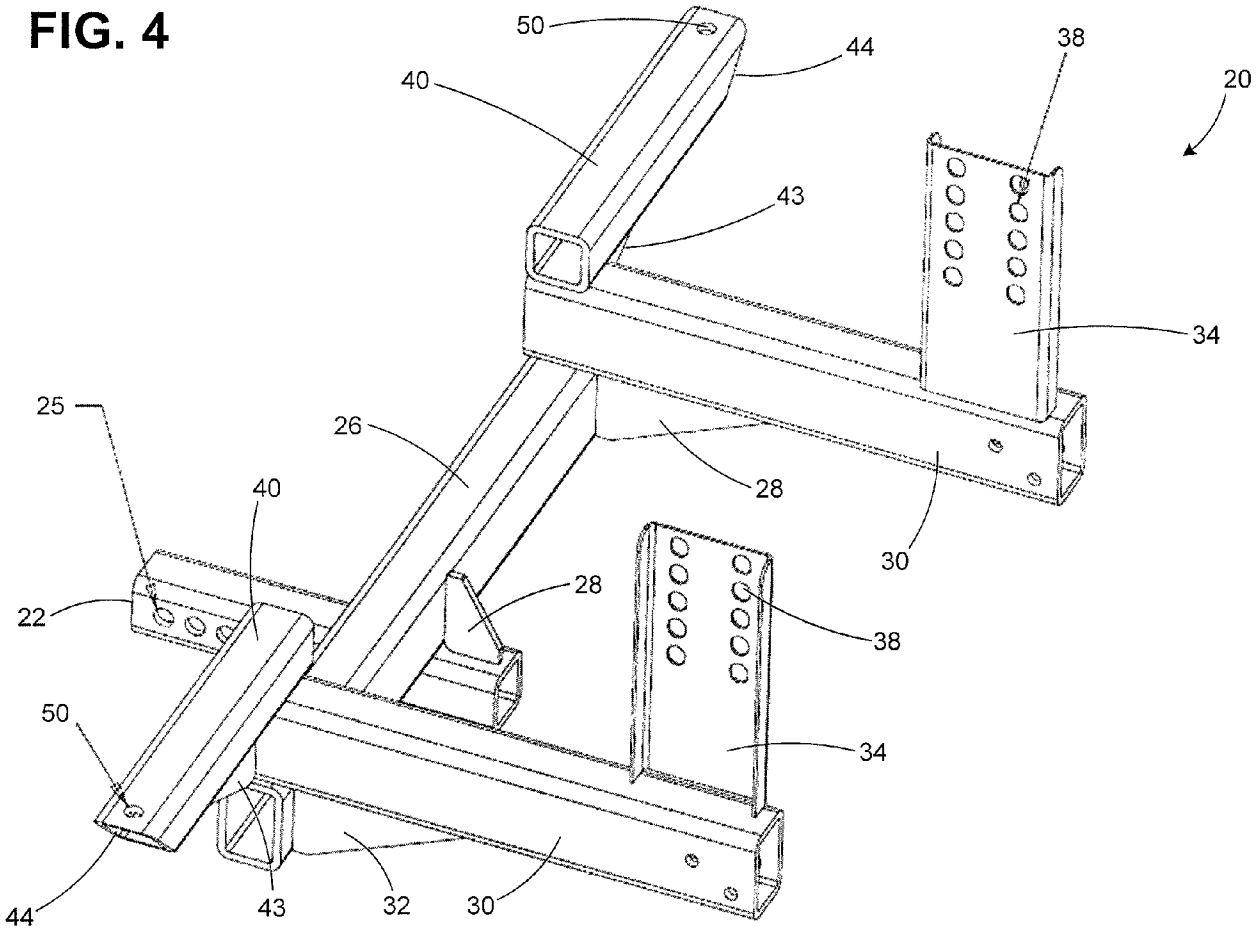
FIG. 4 is an isometric view of a frame for supporting a hopper.

With additional reference to FIG. 4, the material spreader 10 includes a frame 20 having a forwardly projecting hitch mount 22 configured for coupling to the rearwardly projecting hitch receiver 16 of the vehicle. The receiver and the mount may be coupled in any conventional manner, for example, by inserting the mount into the receiver and inserting a locking pin through respective bores 24 in the receiver and the mount. At least one or both of the receiver and mount preferably include a series of holes to provide horizontally adjustable mounting of the frame to the vehicle, which allows the frame to accommodate vehicles having different length bumpers. In the illustrated embodiment, and as best shown in FIG. 4, the mount has a series of horizontally spaced apart holes 25 for this purpose.

The frame 20 includes a horizontal crossbar 26 connected to the hitch mount 22, for example, at a top surface of the hitch mount. The connection between the hitch mount and the crossbar can be reinforced with a gusset 28. Connected to the crossbar, such as a top surface of the cross bar, is a pair of rearwardly extending bars 30. The connection between the crossbar and the rearwardly extending bars also can be reinforced by gussets 32. The rear end portions of the rearwardly extending bars are each connected to a pair of vertical support members 34 such as brackets.

The brackets 34 support a hopper 36. For example, the brackets can be coupled to the hopper by a connecting element 28, for example, a bolt, rivet, screw, etc. Although shown as vertically extending brackets in the exemplary embodiment of FIGS. 1-3, other configurations are possible. For example, the frame can include a horizontal or angled member for coupling and/or supporting the hopper.

The brackets 34 provide macroscopic (e.g., large scale) adjustments to the height of the hopper 36 relative to the frame 20, thereby facilitating the mounting of the material spreader 10 onto the vehicle 12. The brackets 34 can include a plurality bores 38 at different vertical heights for connecting the frame 20 to the hopper 36 at a variety of different heights relative to the frame. The brackets therefore allow the material spreader 10 to be vertically adjusted for mounting to vehicles having different vertical distances between the bumper 14 and the hitch receiver 16. For example, in the exemplary embodiment of FIG. 1, the hopper can be connected to the brackets by connecting elements 39 though the second set of bores from the top of the brackets. Other vehicles may have different bumper heights and in such vehicles, the frame and the hopper can be connected with a connecting element through a different set of bores in the brackets so as to increase/decrease the distance between the hopper and the frame.

The brackets 34 are rearwardly located on the frame relative to a pair of laterally extending bars 40 configured for connection to respective tie downs 42, which are located on the front portion of the frame. The laterally extending arms are supported by gussets 43. In the illustrated embodiment the bars are spaced apart from one another, however, other arrangements also are possible. For example, in an alternative embodiment, the bars can be configured as a unitary piece (e.g., only a single bar may be utilized and the bars need not be straight.

The tie downs 42 are connected to the frame 20, for example, at the ends of the laterally extending bars 40. As shown best in FIGS. 2 and 4, the lateral bars can include a bore 50 for receiving the tie down 42. The tie down 42 also is connected to the hopper 36, and as the tie down is drawn down (e.g., tightened), the frame 20 and the hopper are urged towards one another to engage the material spreader 10 onto the bumper 40. The ends 44 of the lateral bars are preferably angled to allow access to the tie down, for example, to allow access to a nut on the tie down whereby the nut can be tightened to draw the hopper 36 down towards the frame.

The material spreader 10 includes a support 60 having an underside for resting atop a top surface 61 of the bumper 14. The support 60 may be a generally planar surface. In a preferred embodiment, the support 60 is formed by and is thereby unitary with the hopper 36. For example, the support can be a bottom surface of the hopper, such as a laterally extending shoulder on the bottom of the hopper that rests atop the rear bumper. Additionally or alternatively, the support can include a portion of the frame, for example, a laterally extending generally planar surface for resting on top of the bumper. Although different configurations are possible, the description herein will primarily refer to the support as a bottom surface of the hopper, however, it will be appreciated that the principles described herein are equally applicable to other support configurations.

The support 60 (e.g., the bottom surface of the hopper) is vertically movable relative to the frame 20. For example, as described above, large scale adjustments to the height of the hopper 36 can be effected by connecting the hopper to different bores 28 in the vertical support members 34 to thereby raise/lower the hopper. Small scale adjustments (e.g., fine tuning) of the height of the hopper relative to the frame can be effected through the tie downs 42 connected to the support and the frame 20, and the tie downs are configured to urge the support 60 and the hitch mount 22 towards one another to effect a clamping action on the bumper 14 and the hitch receiver 16.

Figure 5:
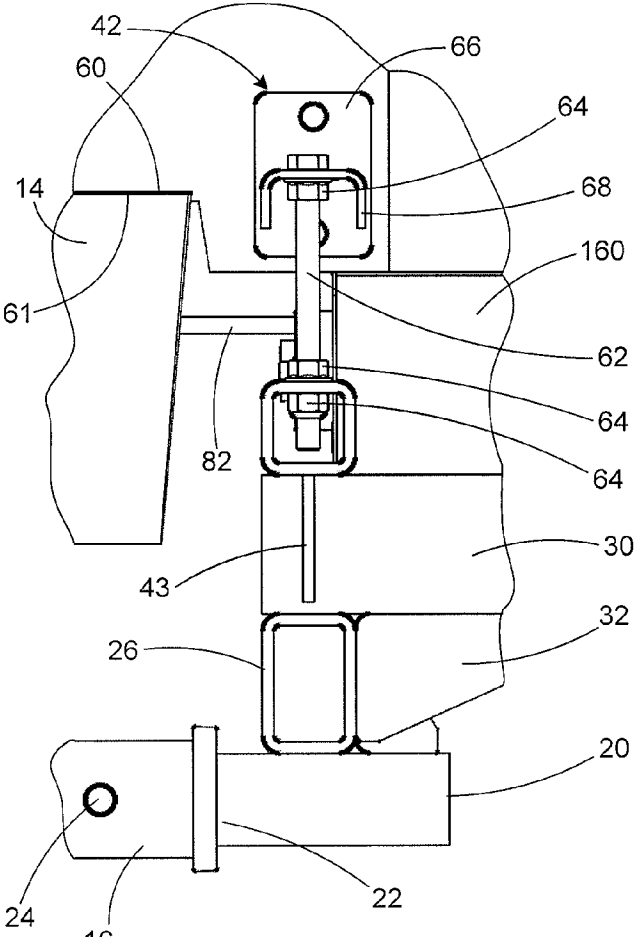
FIG. 5 is an enlarged view of an exemplary tie down.

An enlarged view of an exemplary tie down 42 is shown in FIG. 5. The tie down 42 is connected to the frame 20 and the hopper 36. The tie down 42 can be an adjustable member for controlling the clamping action and the force applied to the bumper 14 and the hitch receiver 16. In the exemplary embodiment of FIG. 5, the tie down 42 is a threaded bolt 62 connected to the lateral arm 40 by inserting the bolt through the bore 50 in the arm and securing the bolt onto the arm by a pair of nuts 64, e.g., locking nuts, on either side of the top wall 46 of the arm 40. The opposite end of the bolt is connected to the hopper 36. The tie down may be connected to the hopper, for example, by a bracket 66 connected to the hopper. In the embodiment of FIG. 5, the bracket 66 includes a downwardly facing U-shape projection 68, and the bolt is inserted through a hole in the bracket and through the hole 50 in the lateral arm. The bolt can be tightened to thereby urge the hopper towards the frame and effect a clamping action the hitch receiver and the bumper. As shown in FIG. 2, the other side of the frame and hopper can be configured for connection to a second tie down. Although shown as a threaded bolt arrangement, it will be appreciated the tie downs may be other retention mechanisms for drawing the hopper towards the frame for effecting a clamping action, such as, ratchet straps, buckles, clips, belts, etc.

The clamping action between the bumper 14 and the hitch receiver 16 holds the material spreader 10 on the bumper by applying an upward force on the hitch receiver with the hitch mount 22 and by applying a downward force on the bumper 14 with the support 60. The magnitude of the clamping force can be adjusted by adjusting the tension in the tie downs 42, for example, by tightening/drawing down the bolt or loosening the bolt 62. The weight of the hopper can be supported at least partially by the hitch receiver and the bumper when the material spreader is mounted to the vehicle.

As mentioned above, the support 60 of the material spreader 10 rests atop the bumper 14 and the material spreader is mounted to the bumper with a clamping force.

The material spreader therefore does not require or cause permanent modifications to the truck to effect a secure attachment thereto. Additionally, removal of the material spreader can be accomplished by loosening the lock member to thereby relieve the clamping force on the bumper by the hopper, allowing the hopper to be slid off of the bumper after disengaging the hitch receiver from the hitch mount on the frame.

Additional features of the material spreader 10 are shown in FIG. 2. The material spreader may include a vibrator 80 for facilitating the transport of spreadable material from the hopper 36 to a spinner by vibrating the material spreader to reduce the likelihood of the material becoming jammed. The vibrator can be connected to an electrical supply, for example the battery of the vehicle, by a wiring harness 82. The material spreader also may include a shield 84 for protecting the underside of the truck from the spreadable material as the material is distributed from the material spreader. Additionally, the material spreader may have a protector 86 for protecting the material spreader from damage, for example, by shielding the material spreader. The protector extends rearwardly outward from the frame such that the protector contacts any objects behind the truck before the material spreader, thereby reducing the likelihood of the spreader being damaged, for example, if the truck is accidentally backed up into a snow bank or another object.

With additional reference to FIGS. 6-10, the hopper 36 is shown in more detail. The hopper can be any suitable container for holding material to be spread, for example, granular material (e.g., salt or sand) and/or a liquid material. In the illustrated embodiment, the hopper is generally rectangular in shape and has sloping side walls for funneling material to both an auger and a spinner, as described in more detail below. The hopper is connected to and supported by the frame 20 as described above. The open top of the hopper can be closed with a removable lid 100.

Figure 7:
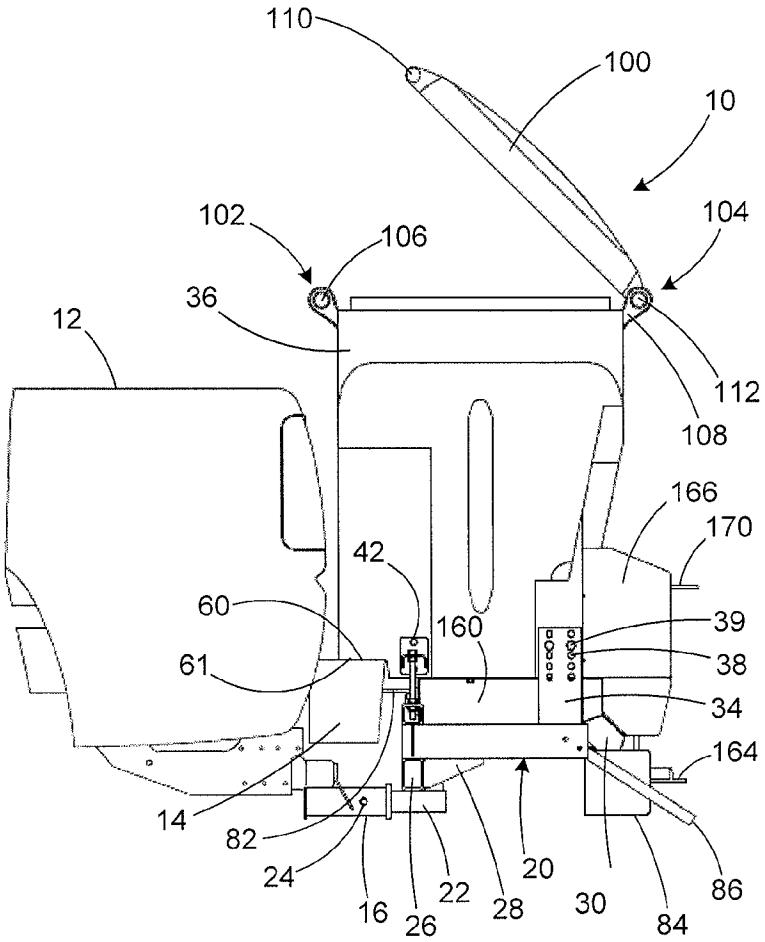
FIG. 7 is a side view of the hopper with the lid opened to a second open position.
Figure 6:
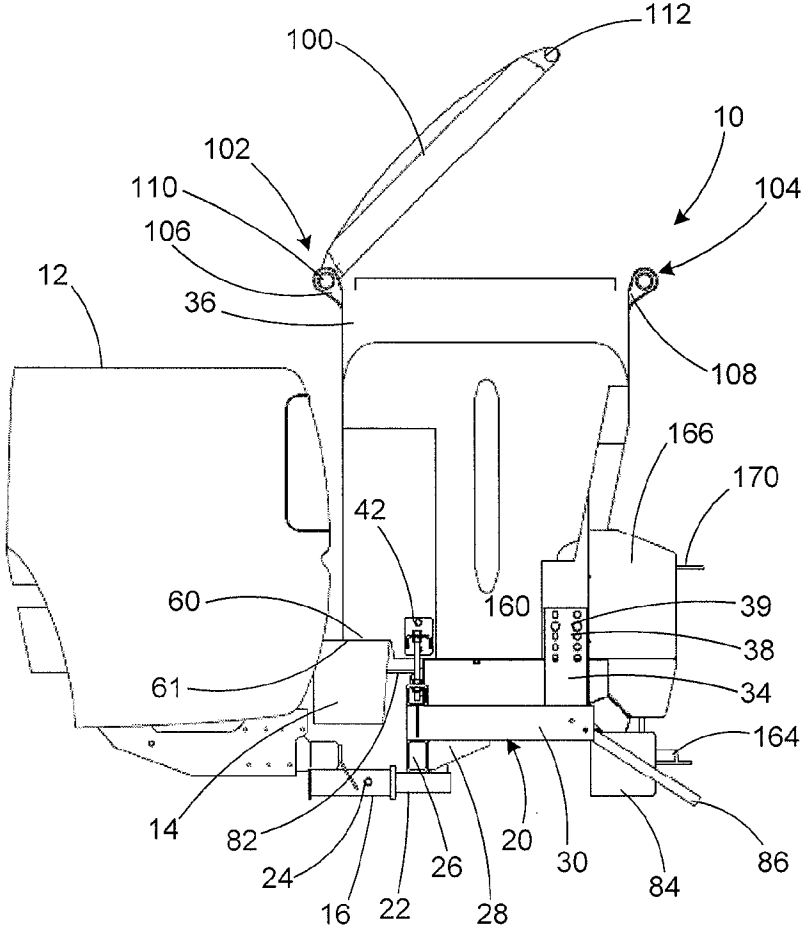
FIG. 6 is a side view of the hopper with a hopper lid opened to a first open position.

As shown best in FIGS. 6 and 7, the lid 100 is a dual hinged removable lid that is releasable such that the lid can be opened to different open positions to allow the hopper to be loaded from different sides. For example, the lid can be openable to a first open position (FIG. 6) so that the hopper can be loaded from the rear of the vehicle, and a second open position (FIG. 7) so that the hopper can be loaded from the truck (e.g., with material stored in the bed of the truck).

The material spreader includes two sets of hinges located on different sides of the material spreader for opening the lid. As shown in the illustrated embodiment, one hinge 102 is located on a frontward side of the material spreader 10 and a second hinge 104 is located on a rearward side of the material spreader, however, the hinges can be located on adjacent sides of the material spreader (e.g., perpendicular to one another) or on the left and right sides of the hopper. Additionally, the hinges can be configured for connection to different shaped lids, for example, as may be used circular, rectangular, or other shaped hoppers. The hinges 102 and 104 include both hopper hinge elements and lid hinge elements.

The hopper 36 has a first set of laterally spaced apart hopper hinge elements 106 on one side (e.g., the front side of the hopper) and a second set of laterally spaced apart hopper hinge elements 108 on a different side (e.g., the rear side of the hopper). Likewise, the lid has respective sides with corresponding first and second sets of laterally spaced apart lid hinge elements 110 and 112 configured for releasable connection to corresponding first and second sets of hopper hinge elements 106 and 108. The lateral spacing between the hinge elements is best shown in FIGS. 1 and 2 with respect to the rearward hinge.

In the illustrated embodiment, the hopper hinge elements 106 and 108 are hinge bodies and the lid hinge elements 110 and 112 are hinge pins, however, it will be appreciated that other configurations are possible, for example, the hopper hinge elements can be configured as hinge pins and the lid hinge elements can be configured as hinge bodies, or the hopper and lid may include a combination of hinge bodies and hinge pins.

When the lid 100 is in a closed position (e.g., as shown in FIGS. 1-3) the frontward hinge 102 and rearward hinge 104 hold the lid 100 closed. For example, in the closed position, the corresponding first sets of hinge elements (e.g., the front hinge bodies 106 and hinge pins 110) engaged and the corresponding second sets of hinge elements (e.g., the rear hinge bodies 108 and rear hinge pins 112) are engaged. The corresponding sets of hinge elements are configured for releasable connection to one another to allow the lid to pivot upwardly to an open position. From the closed position the lid can be opened to the first open position (FIG. 6) or the second open position (FIG. 7).

As shown in FIG. 6, when the lid 100 is opened to the first open position (e.g., for loading the material spreader from the rear of the truck), the first corresponding set of hinge elements are engaged, and the corresponding second set of hinge elements are releasable to allow the lid to pivot upwardly about the front hinge 102 to the first open position.

As shown in FIG. 7, when the lid 100 is opened to the second open position (e.g., for loading the material spreader from the bed of the truck), the second corresponding set of hinge elements are engaged, and the first corresponding set of hinge elements are releasable to allow the lid to pivot upwardly about the rear hinge 104 to the second open position.

The corresponding sets of hinge elements can be releasable by laterally deflecting one of the sets of hinge elements relative to the other. For example, the hinge bodies 108 on the hopper can be resiliently laterally deflected to release the corresponding hinge pins 112 on the lid. The hinge bodies can be laterally deflected by applying a lateral force to the hinge body, thereby causing the hinge body to deflect laterally to disengage and release the hinge pin, thereby to allow the lid to pivot on the other corresponding set of hinge elements.

Each hinge body (e.g., hopper hinge elements 106 and 108 in FIGS. 8-10) include an axially extending through bore 114 for receiving respective hinge pins 110 and 112. The hinge pins 110 and 112 have corresponding axially extending protrusions 116, for example, nubs, which are sized for insertion into the bore of a corresponding hinge body to thereby engage the hinge pin and hinge body. As shown in the broken lines in FIG. 10, the hinge body is resiliently laterally deflectable to a deflected position 118 to release the corresponding hinge pin 112. For example, the hinge body can be deflected such that the hinge pin can be vertically lifted relative to the hinge body to move the lid from a closed position to an open position.

The deflection in the hinge bodies 106 and 108 may be facilitated by forming the hinge bodies with a resiliently flexible material, for example, a thermoplastic elastomer. Additionally or alternatively, one set of hinge elements can be resiliently mounted for deflection, for example, by coupling the hinge elements to a resilient member such as a spring mount. The hinge pins also may include spring-loaded axially extending pins that can be pressed laterally inwardly to disengage the hinge pin from the hinge body. In a preferred embodiment, the force required to deflect the hinge elements laterally to release the corresponding set of hinge elements is about 10-15 pounds of force.

The hinge pins 110 and 112 may be unitary with the lid, for example, by a molding process. Likewise, the hinge bodies 106 and 108 may be unitary with the hopper and formed by a molding process. Alternatively, the hinge pins and hinge bodies can be connected to the lid and hopper, for example, by mounting the hinge elements to the hopper and lid with brackets or another connecting mechanism. In the exemplary embodiment of FIGS. 6-10, the lid hinge elements are integrally formed with the lid and the hopper hinge elements are connected to the hopper by brackets 120.

Figure 10:
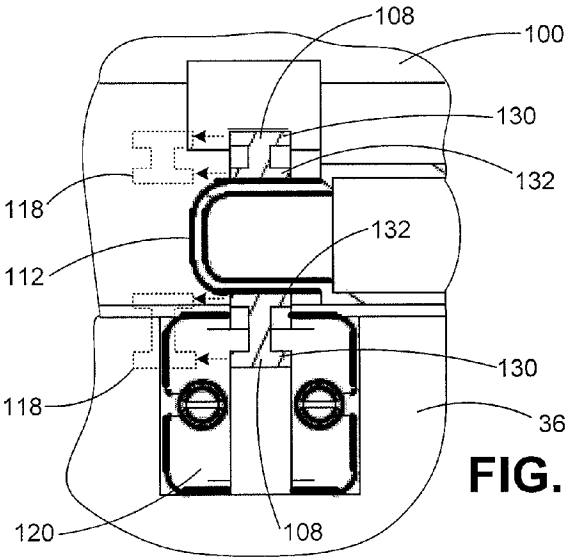
FIG. 10 is an enlarged fragmentary sectional view of one of the hinges of FIG. 9.

The hinge pins 110 and 112 can be inserted into the hinge bodies 106 and 108 by laterally flexing the hinge bodies 106 and 108 apart from one another and sliding each hinge pin through the bore in each corresponding hinge body. For example, the deflected position of the hinge is illustrated by the dashed lines of FIG. 10. Due to their resiliency, the hinge bodies flex back to the unflexed state, thereby surrounding the hinge pins and retaining the lid. Likewise, the hinge pins can be released from the hinge bodies by flexing the hinge bodies laterally outward, thereby releasing the pin from the bore. Additionally or alternatively, the hinge pins may be laterally deflectable to disengage the hinge pins from the hinge bodies. In the embodiment of FIG. 10, the hinge body is shown in broken lines in a laterally outwardly deflected state (e.g., away from the corresponding hinge body) for disengaging the hinge body from a hinge pin inserted into the bore through an inner side of the hinge body. It should be appreciated that the hinge body could likewise be deflected to an inwardly deflected state (e.g., towards the corresponding hinge body) for disengaging the hinge body from a hinge pin that is inserted into the bore through an outer side of the hinge body.

Figure 9:
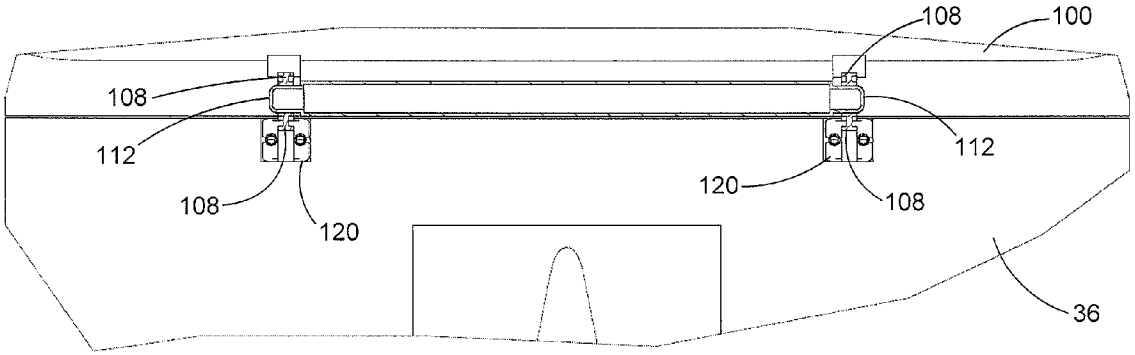
FIG. 9 is a fragmentary sectional view of the hinge of FIG. 8 taken along the lines B-B.
Figure 8:
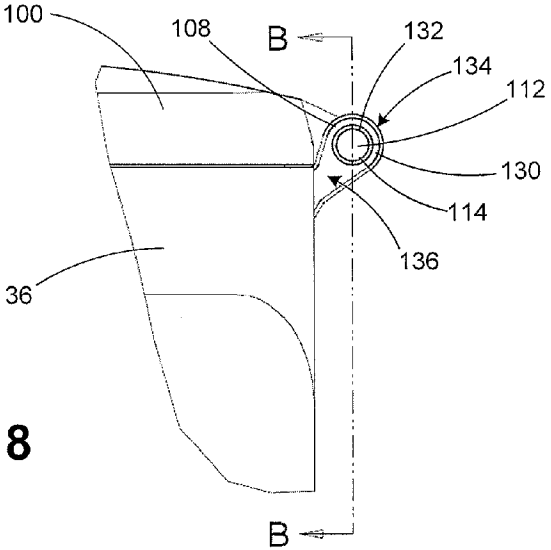
FIG. 8 is a fragmentary side view of an exemplary hinge connecting the lid to the hopper.

As shown best in FIGS. 8-10, the hinge body 108 includes an outer support wall 130 extending outwardly from an outer portion of the hinge body, and an inner support wall 132 extending outwardly around the bore 114. The inner and outer support walls 130 and 132 strengthen the hinge body by increasing the rigidity of the hinge body in the area 134 in which the support walls are close to one another and allow flexion in the area 136 of the hinge body in which the support walls are further apart from one another.

As shown best in FIG. 8, the outer support wall 130 and the inner support wall 132 are spaced closer to one another around at least a portion of the bore and further apart from one another where the hinge body is connected to the hopper. The hinge body is therefore more flexible near the connection point than around the bore. In such an arrangement, the support walls can facilitate flexion in the region of the hinge body that can effect the greatest lateral deflection of the bore relative to the connection point for facilitating release of the hinge pin from the hinge body. The outer support walls also strengthen the hinge body in the area surrounding the bore where the hinge element may be exposed to forces from the lid, for example, from rotating the lid opened/closed.

Figure 11:
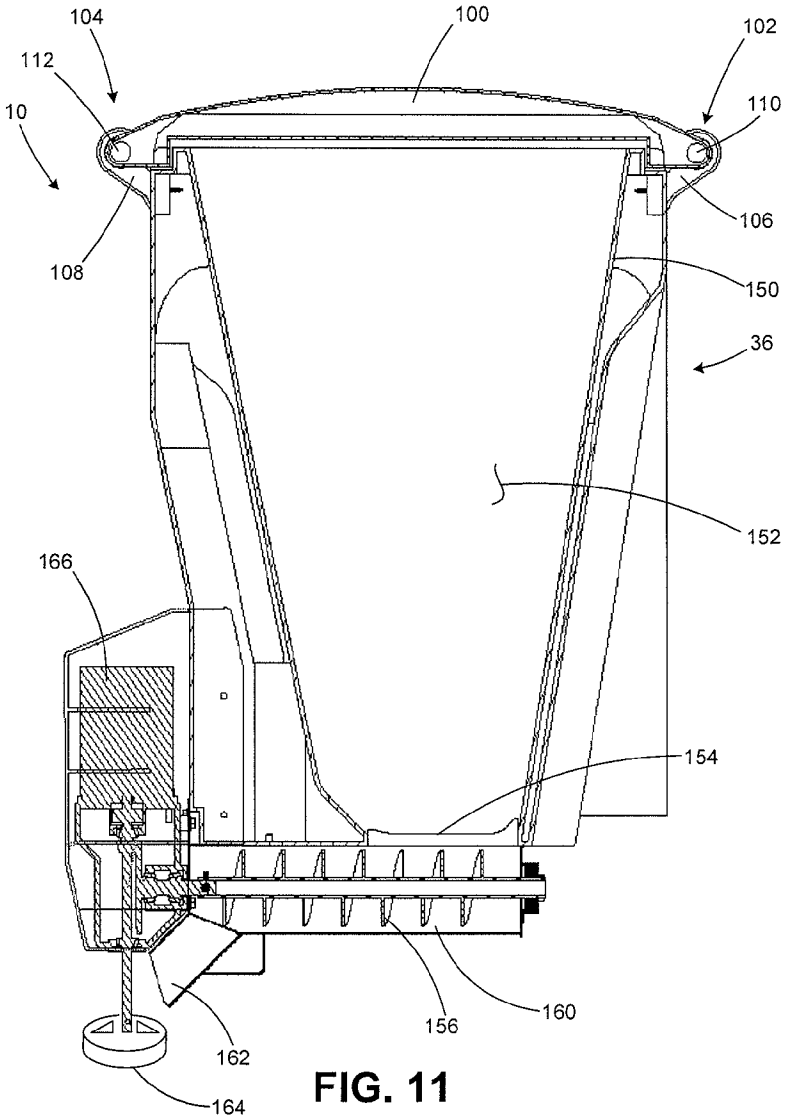
FIG. 11 is a cross-sectional view of a material spreader showing a spinner and an auger.

Referring now to FIG. 11, the rear portion of the spreading mechanism is shown in greater detail. As shown in FIG. 11, the hopper 36 includes outer walls 150 that surround an interior space 152 of the hopper in which the spreadable material can be loaded. The material is fed through the bottom 154 of the hopper to an auger 156.

The auger 156 can be a helical rotating member for feeding the material from the hopper 36 through a trough 160 located below the hopper. The material is transported from the trough to a chute 162 where the material is deposited onto a spinner 164. The spinner rotates to distribute the material, for example, by outwardly scattering or spraying the material.

Figure 12:
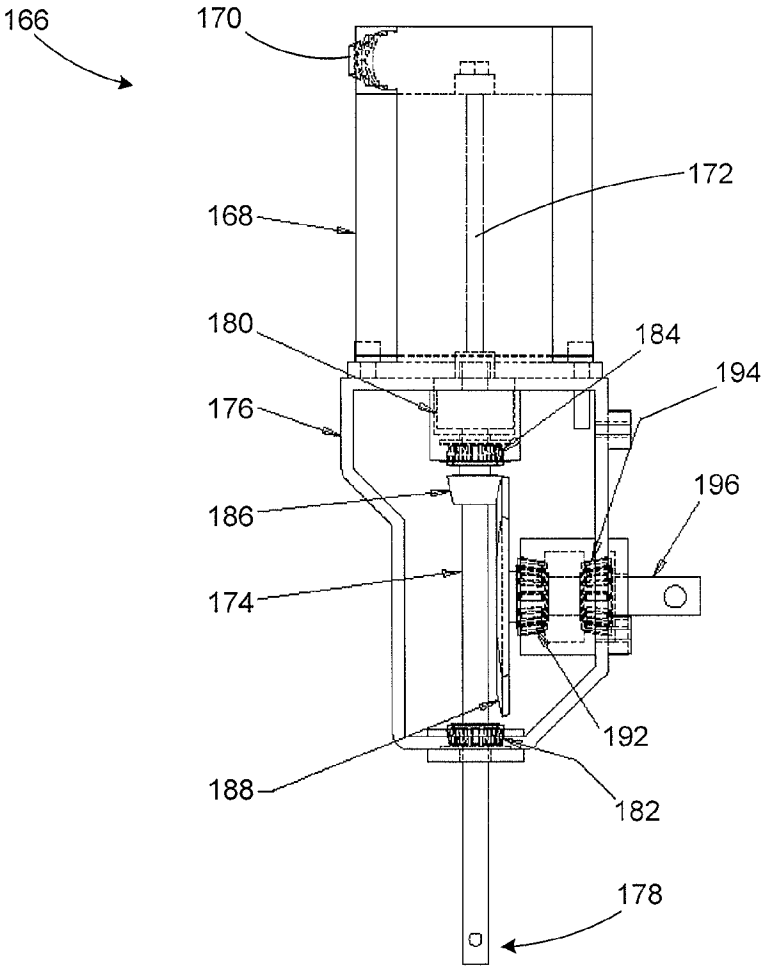
FIG. 12 is a cross-sectional view of an exemplary drive assembly for the material spreader.

The auger and the spinner are driven in a synchronous relationship by a drive assembly 166, which shown in FIG. 11 and FIG. 12. The drive assembly 166 is suitable attached to the frame and/or the hopper 36. As shown in the illustrated embodiment of FIG. 11 and FIG. 12, the gear box is attached to a rear side of the hopper 36.

The drive assembly 166 includes an electric motor 168 that is coupled by a wire harness 170 to a power supply, for example, the battery of the truck. The electric motor supplies power to a motor shaft 172 that is coupled to a drive shaft 174 in a gear box case 176. The drive shaft 174 is connected at one end by a coupling 178 to the motor shaft 172. The opposite end 178 of the drive shaft 174 is configured for connection to the spinner 164, whereby the spinner operates at the same rotational speed as the motor. The gear box case 176 also includes a pair of bearings 182 and 184 that surround the drive shaft 174.

The gear box case 176 also includes a gear reduction assembly connected between the auger and the drive shaft for driving the auger at a slower rotational speed that the spinner. The gear reduction assembly includes a small gear 186 on the drive shaft 174 in mesh with a large gear 188 on a second drive shaft 190. The gear box case also includes bearings 192 and 194, which surround the second drive shaft 190 to facilitate rotation thereof. The second drive shaft has an end 196 configured for connection to the auger 156.

The gear reduction assembly and the direct connection of the drive shaft to the spinner provides a drive assembly that is free from chains, belts and pulleys, which are subject to substantial wear and tear, and which break down over time, and which frequently need to be serviced and replaced. In contrast, the drive assembly drive disclosed herein has relatively few parts requiring service and therefore is less likely to break down than conventional chain/belt/pulley arrangements.

Although the invention has been shown and described with respect to a certain preferred embodiment or embodiments, it is obvious that equivalent alterations and modifications will occur to others skilled in the art upon the reading and understanding of this specification and the annexed drawings. In particular regard to the various functions performed by the above described elements (components, assemblies, devices, compositions, etc.), the terms (including a reference to a "means") used to describe such elements are intended to correspond, unless otherwise indicated, to any element which performs the specified function of the described element (i.e., that is functionally equivalent), even though not structurally equivalent to the disclosed structure which performs the function in the herein illustrated exemplary embodiment or embodiments of the invention. In addition, while a particular feature of the invention may have been described above with respect to only one or more of several illustrated embodiments, such feature may be combined with one or more other features of the other embodiments, as may be desired and advantageous for any given or particular application. Furthermore, directional modifiers (e.g., front, back, upper, top, lower, bottom, above, below, left-hand, right-hand, etc.) are used only for ease in explanation in connection with the illustrated orientation and do not, unless otherwise indicated, limit the elements to any specific orientation.

The invention claimed is:

1. A material spreader mountable to a vehicle for conveying and spreading material, the material spreader comprising:

a hopper for holding material to be spread, a lid for closing an open top of the hopper, and a frame mountable to the vehicle for supporting the hopper, the hopper respectively having at different sides of the hopper respective first and second sets of laterally spaced apart hopper hinge elements, and the lid having first and second sets of laterally spaced apart lid hinge elements respectively configured for connection to corresponding first and second sets of hopper hinge elements, the first and second sets of lid hinge elements configured to cooperate with the corresponding first and second sets of hopper hinge elements to hold the lid down when the lid is in a closed position, and the hinge elements of a first one of the corresponding sets being resiliently releasable to allow the lid to pivot upwardly to a first open position about the hinge elements of a second one of the corresponding sets, and the hinge elements of the second one of the corresponding sets being resiliently releasable to allow the lid to pivot upwardly to a second open position about the hinge elements of the first one of the corresponding sets.

2. The material spreader of claim 1, wherein at least one set of hinge elements in each corresponding set of hinge elements are resiliently laterally deflectable.

3. The material spreader of claim 1, wherein at least one set of hinge elements in each corresponding set of hinge elements is resiliently mounted for deflection.

4. The material spreader of claim 3, wherein the resiliently mounted hinge elements are spring mounted.

5. The material spreader of claim 1, wherein one set of hinge elements in each corresponding set of hinge elements are hinge pins and the other set of hinge elements in each corresponding set of hinge elements are hinge bodies.

6. The material spreader of claim 5, wherein the hinge bodies include a support wall on an outer portion of the hinge bodies.

7. The material spreader of claim 5, wherein the hinge bodies have a bore and an inner support wall surrounding the bore.

8. The material spreader of claim 7, wherein the hinge pins are insertable into the bores of respective hinge bodies.

9. The material spreader of claim 1, further comprising:

a spinner;

an auger for feeding material from the hopper for deposit on the spinner; and a drive assembly for driving the auger and the spinner in synchronous relationship, the drive assembly including a motor, a drive shaft connected at one end to the motor and connected at an opposite end to the spinner so that the spinner operates at the same rotational speed as the motor, and a gear reduction assembly connected between the auger and the drive shaft for driving the auger at a slower rotational speed than the spreader.

10. The material spreader of claim 9, wherein the gear reduction assembly includes a gear on the drive shaft in mesh with a gear on a second drive shaft and the second drive shaft is drivingly coupled to the auger.

11. The material spreader of claim 1, wherein the different sides are opposite one another.

12. A material spreader mountable to a vehicle for conveying and spreading material, the material spreader comprising:

a hopper for holding material to be spread, a lid for closing an open top of the hopper, and a frame mountable to the vehicle for supporting the hopper, the hopper respectively having at different sides of the hopper respective first and second sets of laterally spaced apart hopper hinge elements, and the lid having first and second sets of laterally spaced apart lid hinge elements respectively configured for connection to corresponding first and second sets of hopper hinge elements, and the hinge elements of a first one of the corresponding sets being releasable to allow the lid to pivot upwardly to a first open position about the hinge elements of a second one of the corresponding sets, and the hinge elements of the second one of the corresponding sets being releasable to allow the lid to pivot upwardly to a second open position about the hinge elements of the first one of the corresponding sets;

wherein one set of hinge elements in each corresponding set of hinge elements are hinge pins and the other set of hinge elements in each corresponding set of hinge elements are hinge bodies;

wherein the hinge bodies have a bore and an inner support wall surrounding the bore and an outer support wall on an outer portion of the hinge bodies; and wherein the outer support wall and the inner support wall are spaced closer to one another around at least a portion of the bore and further from one another at a connection point to the lid or to the hopper, whereby the hinge is more flexible near the connection point than around the bore.

* * * * *